US006213630B1

(12) United States Patent
Kossmann

(10) Patent No.: US 6,213,630 B1
(45) Date of Patent: Apr. 10, 2001

(54) UNBALANCED VIBRATOR FOR STONE FORMING MACHINES

(75) Inventor: Olga Kossmann, Weissenthurm (DE)

(73) Assignee: Masa AG, Andernach (DE)

( * ) Notice: Subject to any disclaimer, the term of this patent is extended or adjusted under 35 U.S.C. 154(b) by 0 days.

(21) Appl. No.: 09/274,933

(22) Filed: Mar. 23, 1999

(30) Foreign Application Priority Data

Mar. 24, 1998 (DE) ..... 198 12 986

(51) Int. Cl.[7] ..... B01F 11/00
(52) U.S. Cl. ..... 366/128; 366/219
(58) Field of Search ..... 366/128, 237, 366/239, 240, 219, 108, 116; 74/61

(56) References Cited

FOREIGN PATENT DOCUMENTS 43 17 351 A1 12/1994 (DE) .
44 07 013 A1 9/1995 (DE) .
297 12 242 U1 10/1997 (DE) .

*Primary Examiner*—Tony G. Soohoo
(74) *Attorney, Agent, or Firm*—Akin, Gump, Strauss, Hauer & Feld, LLP

(57) ABSTRACT

An unbalanced vibrator for compacting concrete components during their manufacture has a vibrating table, unbalance shafts arranged on the vibrating table, and electronic motors allocated to the unbalance shafts in order to drive them, wherein the electronic motors have a device for the control and/or regulation of the rotational speed and/or the relative phase position of the unbalance shafts. The unbalanced vibrators of this type should be adjustable in an extremely rapid manner, in order to shorten manufacturing processes. For this purpose the electronic motors are designed as servo-motors and are provided with a device having sine-cosine transmitters, which determine the angular position and rotational speed of the unbalance shafts, such that the entire regulation/control can occur in a fully digitalized manner.

31 Claims, 5 Drawing Sheets

UNBALANCED VIBRATOR FOR STONE FORMING MACHINES

BACKGROUND OF THE INVENTION

The invention involves an unbalanced vibrator for compacting concrete components during their manufacture, in particular an unbalanced vibrator having a vibrating table, unbalance shafts arranged on the vibrating table, and electronic motors allocated to the unbalance shafts for driving them, wherein the unbalanced vibrator has a device for the control and/or regulation of the rotational speed and/or the relative phase position of the unbalance shafts.

A device of this type is known, for example, from German utility model DE-U-297 12 242. According to this document, asynchronous three phase a.c. motors are used as electronic motors, and the unbalance shaft control or regulation is accomplished via vector regulators.

It is disadvantageous in this known device that asynchronous machines react relatively sluggishly to the corresponding control or regulation signals. Since, however, even a slight angular displacement of the unbalance shafts in their "neutral position" can lead to an undesired vibration of the vibrating table, this is considered a disadvantage.

Also, from German published patent application DE-A-43 17 351, a comparable vibrating device is known. According to this document, incremental transmitters are provided in order to detect the position that the unbalanced masses have relative to each other. However, these incremental transmitters have a very limited resolution so that the system also has only limited synchronization properties.

In a vibrating device, as is known from German published patent application DE-A-44 07 013, operation is by hydraulic actuators and servo components. These are relatively sluggish, and thus this system is likewise limited in its dynamics. Since the adjustment times are longer, the cycle times are also prolonged, for example, during block manufacturing. Also, the transmitters used in the prior art in order to detect the position of the unbalance shafts are incremental transmitters having only a limited resolution, which has an unfavorable effect, just as the poor dynamics, on the control performance of the device.

SUMMARY OF THE INVENTION

An object of the present invention is thus to provide an unbalanced vibrator in which a most precise regulation can be achieved, wherein the device for control should have a high dynamic and thus achieve a high control performance.

This objective is achieved according to the invention in that the electronic motors of the device are designed as servo-motors having motor regulation electronics, and the device for control and/or regulation of the rotational speed and/or the relative phase position of the unbalance shafts includes sine-cosine transmitters that determine the angular position and rotational speed of the unbalance shafts.

The advantage of this invention consists in that the servo-motors have a higher dynamic than the related asynchronous machines up to now. Furthermore, servo-motors have the advantage of being able to deliver a considerably higher power than the asynchronous machines having like size, so that presently available constructions can be designed so that they are more powerful. At the same time, the peak loading capability, required only for a short time for the adjustment movements, is also more favorable in servo-motors.

The sine-cosine transmitters provided according to the invention can be obtained having, in addition, a resolution that is considerably above that of traditional incremental transmitters. For demanding regulation tasks, sine-cosine transmitters are obtainable having a resolution that is over 65,000 inc./rev. Thus, even the smallest regulation deviations can be detected and can be immediately counterbalanced because of the good dynamics of the servo-motors.

It has also proven to be advantageous with the sine-cosine transmitters to determine the angular position and the rotational speed of the shafts of the electronic motors, and to connect these shafts to the unbalance shafts via a fixed translation ratio. On the one hand, short signal transmission paths can thus be realized, and on the other hand, the electronic motors can be separated from the vibrating table, for example via cardan shafts, etc., so that they themselves are not exposed to any vibrations and ultimately as well, the sine-cosine transmitters are exposed to a smaller mechanical stress.

In a preferred embodiment, the translation ratio between the electronic motor and the unbalance shaft is 1:1, since in this way, the position of the unbalance shaft can be concluded from the angular position of the motor shaft without additional conversion.

It is favorable, with a total of four unbalance shafts, to couple them in de pairs running in opposite directions via toothed (synchronous) belts. Each pair of coupled together shafts thus lies in a horizontal plane and the individual pairs lie above each other in the vertical direction. This arrangement is very compact and favorable for the vibrating force resulting through the unbalance shafts.

The special mechanical connection via the toothed belts has the advantage that the two coupled unbalance shafts can optimally follow a regulation guideline, without slippage occurring for example, as with V-belts, or play, as occurs with toothed gear drives or the like. Slippage of this type or play of this type acts in a disadvantageous manner on the synchronization of the two coupled shafts, which becomes especially noticeable at the operating point in which all centrifugal forces should be removed, in order to have the vibrating table at rest. At this operating point, even the smallest deviations from the synchronization of the coupled shafts become readily noticeable, since they set the vibrating table into slight oscillations.

For cost reasons it is favorable to couple each pair of unbalance shafts to a servo-motor having motor regulation electronics. By the use of only two motors to drive a total of four axles, considerable costs are saved for additional motors and additional power and regulation electronics.

In order to achieve herein as tight a coupling of several motors as possible, it is proposed with two motors to design one as a master drive and the other one as a slave drive.

It has proven to be favorable herein to integrate a position controller, that synchronizes the slave drive, directly into its motor regulation electronics, since this results in short signal run times between the position controller and the rotational speed regulator, which supports a rapid sensing rate of the individual controller, and thus contributes to good regulation dynamics.

Each of the motor regulation electronics therein can have a separate evaluation unit for the sine-cosine transmitter allocated to it, which creates the actual values for the individual controllers. This has the advantage that the computational performance remains reserved for the actual regulation.

This acts in an especially advantageous way, especially in the design of the motor electronics in fully digitalized form, wherein the sensing times are kept extremely short, and preferably less than 75 gsec. Such short sensing times are favorable for a quick dynamic control.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 1:
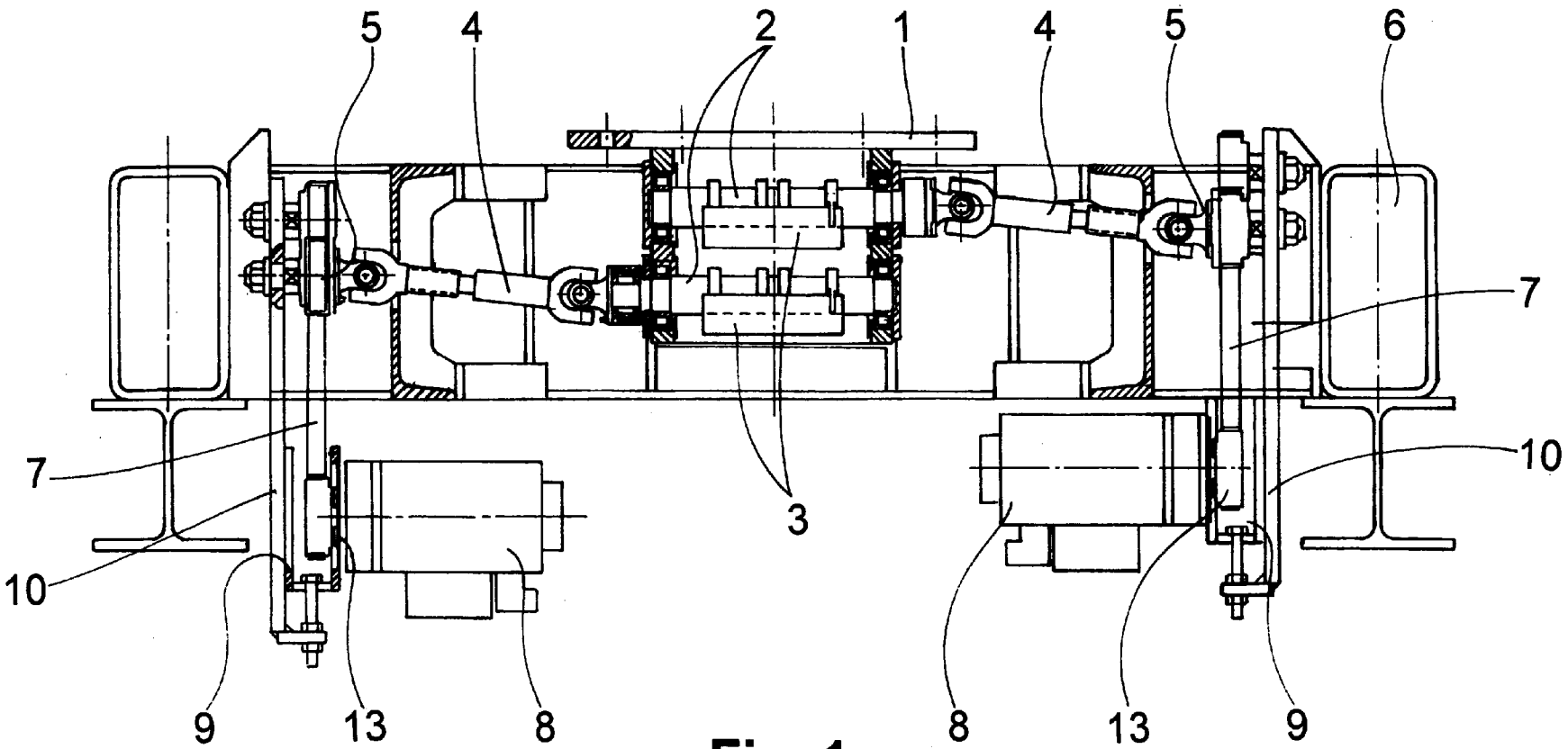
FIG. 1 is the side view of a vibrating table equipped according to the present invention.

In FIG. 1 a longitudinal section through a vibrating device equipped according to the invention is depicted. One recognizes a vibrating table 1, on which a total of four unbalance shafts are arranged. These unbalance shafts have a shaft body 2, on which respective unbalanced masses 3 are attached. The unbalance shafts are connected via cardan shafts 4 to driven gears 5. While the vibrating table is movable by the unbalance shafts, these driven gears 5 are attached rigidly to the machine frame 6, so that the cardan shafts 4 form the connection between the rigid and movable parts of the device.

The driven gears 5 are connected via toothed belts 7 to the electronic motors 8, which are permanent magnet-activated synchronous motors, generally designated as servo-motors. The electronic motors 8 are attached via suitable mounts 9 to the support plates 10 carrying the driven gears 5, in such a way that the toothed belts 7 are to be tensioned by adjusting the mounts 9.

Figure 2:
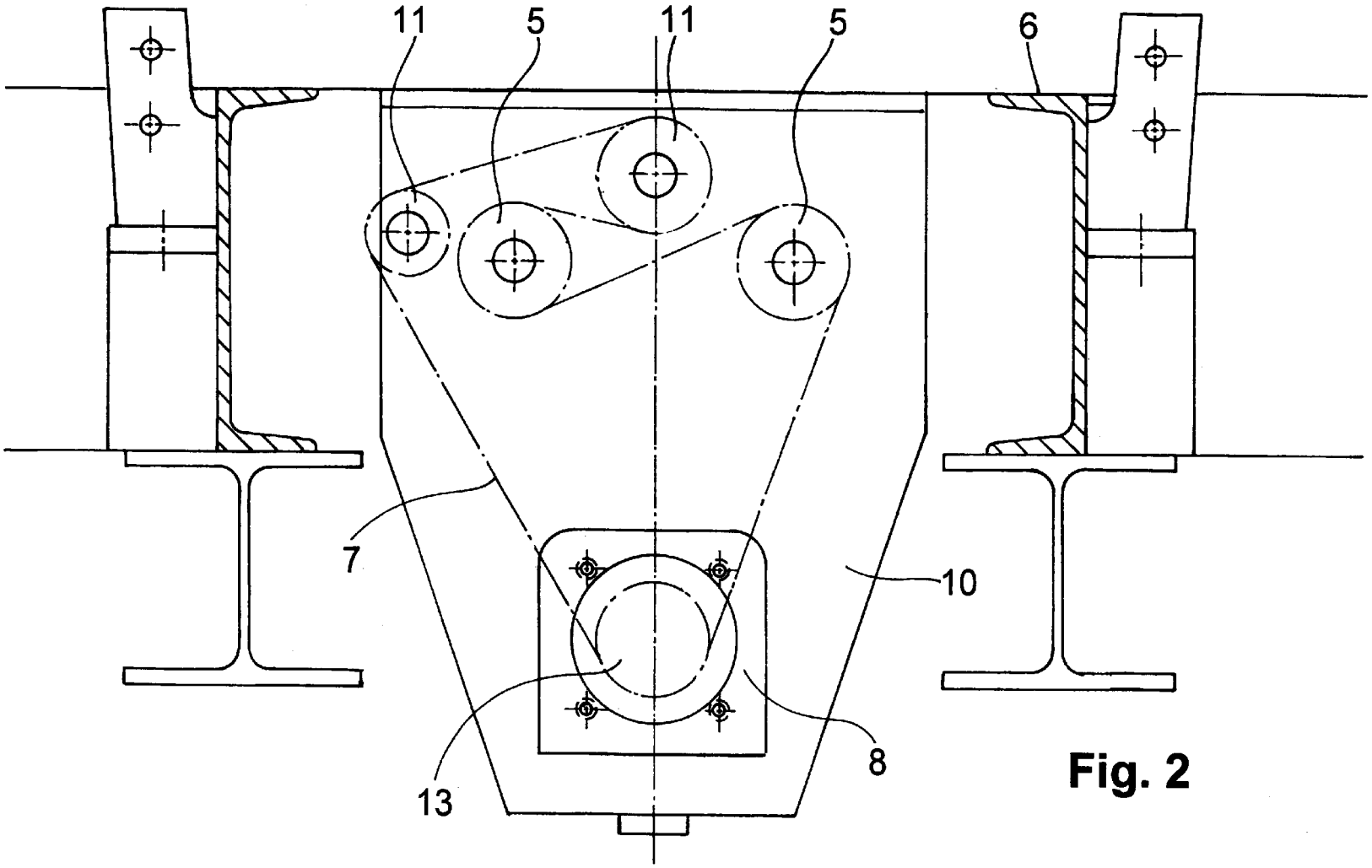
FIG. 2 is the front view of a vibrating table according to the invention.

In FIG. 2 a support plate 10 of this type is depicted in front view. One recognizes the servo-motor 8 arranged at the bottom, which drives the corresponding driven gears 5 via a toothed belt 7. By means of two deflection rollers 11 the two driven gears 5 are caused to rotate in opposite directions. Via the toothed belt 7 it is thus ensured that no slippage or play occurs herein between the two driven gears 5. Consequently, as is recognized in FIGS. 4 and 5, it is achieved that two unbalance shafts lying next to each other in the horizontal direction rotate in exact opposite directions.

Since the drive of the total of four shafts is accomplished with two servo-motors 8, wherein each motor drives two shafts having unbalance weights, it is possible not only to adjust the rotational speed of the four unbalance shafts, but also to adjust the angular displacement of the respective unbalance shaft pairs arranged vertically above each other.

The change in the angle occurs when with one motor the rotational speed is increased or decreased briefly and, after reaching the angular displacement, it continues to run again at the same rotational speed as the other motor .

At a constant rotational speed, the forces generated by the unbalance shafts are to be considered as rotating complex indicators. These indicators can be divided into sine oscillations offset by 90°, wherein one oscillation represents the horizontal force direction and the other oscillation represents the vertical force direction.

By suitable symmetrical positioning of the individual unbalance shafts, the function of the vibrating force from the adjustment angle resulting on the vibrating table is then given by four forces acting in the vertical direction. The horizontal forces thereby cancel each other out at each point in time.

The resulting force is, however, also sinusoidal, wherein the peak value is a function of the adjustment angle as follows:

$$F_R=4\times F_C\times\sin(\alpha)$$

where: $F_R$=peak value of the resulting force;

$F_C$=amount of the centrifugal force of an unbalanced mass; and $\alpha$=adjustment angle.

Figure 3:
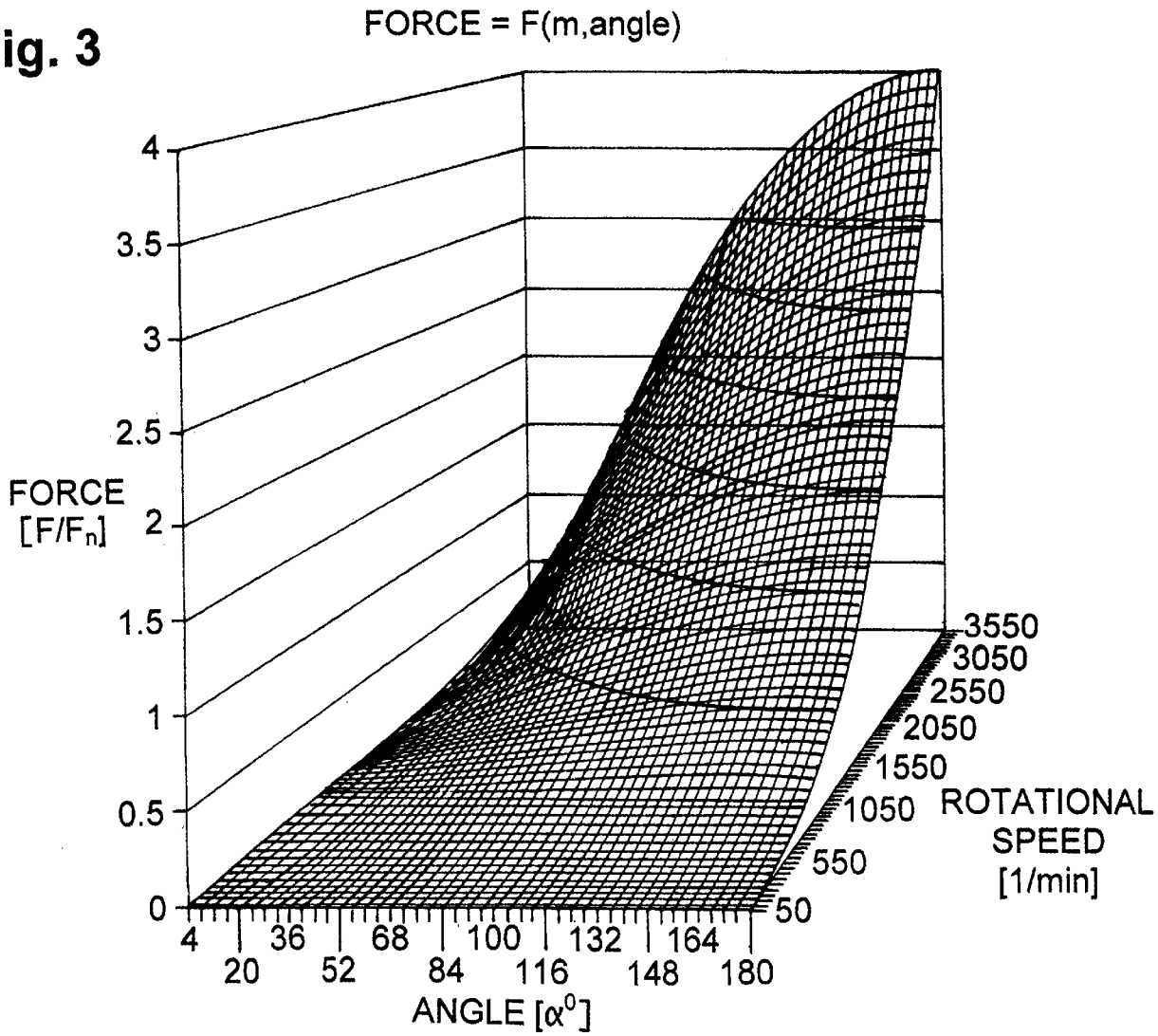
FIG. 3 s hows the vibrating force progression as a function of phase angle and rotational speed.

Thus, the graph depicted in FIG. 3 results for FR as a function of the rotational speed n and the adjustment angle $\alpha$.

Figure 4:
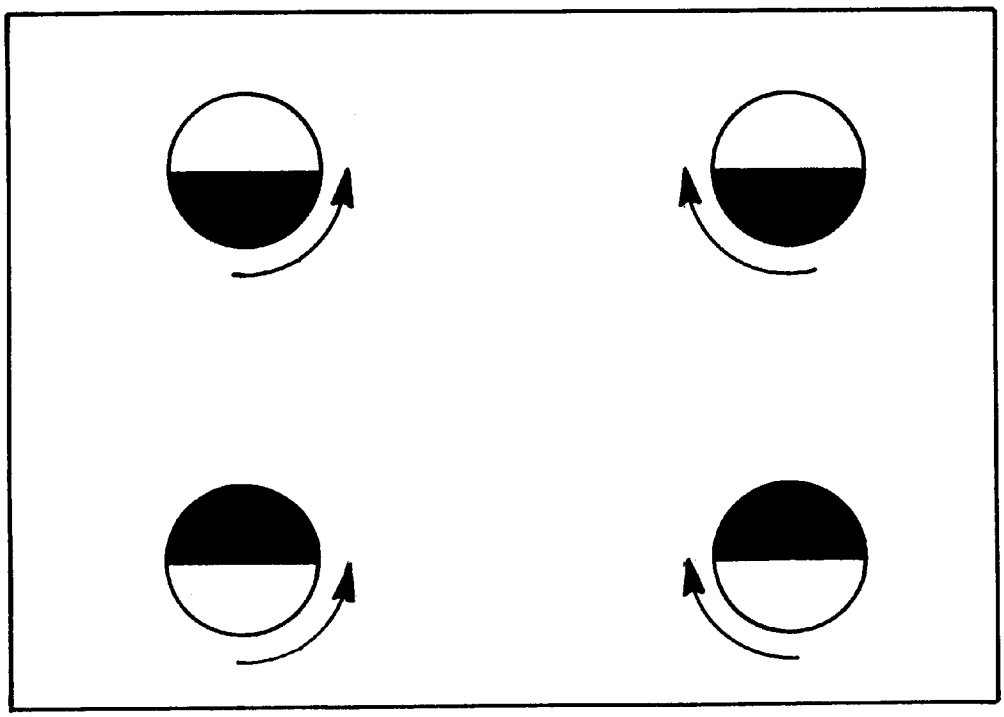
FIG. 4 shows the position of the unbalance shafts in the rest position of the vibrating table.
Figure 5:
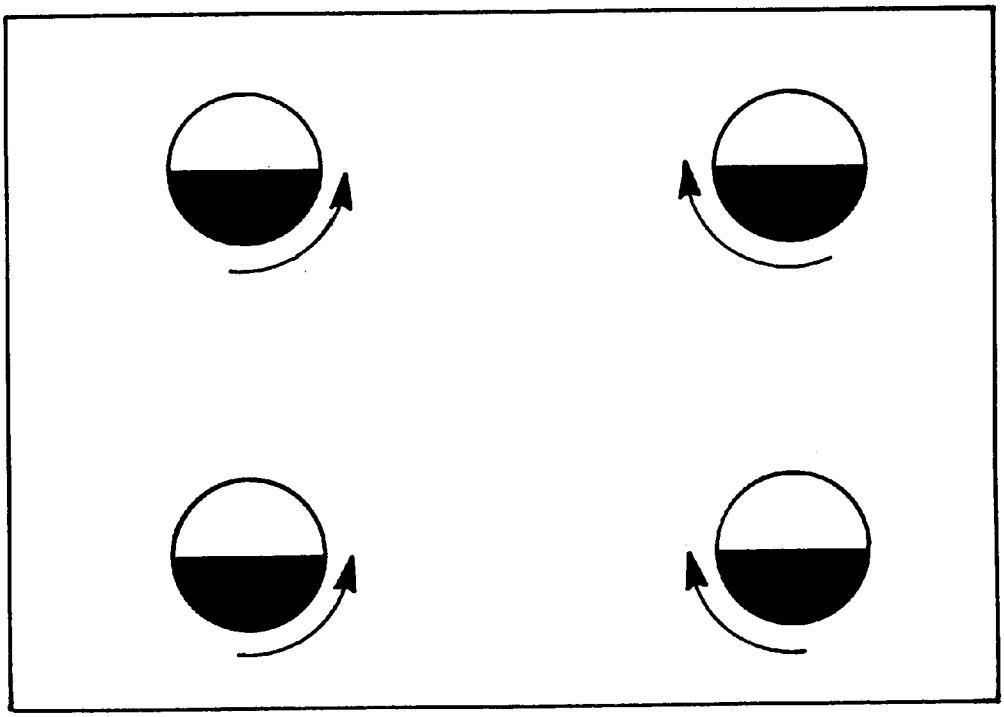
FIG. 5 shows the position of the unbalance shafts during maximum vibrating force.

By the rotational speed being adjustable without restriction and the angular displacement being between 0° and 180°, the vibrating force can thus be adjusted continuously from 0 up to a maximum. In this regard, the position is depicted in FIG. 4, in which no vibrating force results ($\alpha$=0°), while in FIG. 5 the position is depicted in which the maximum vibrating force occurs ($\alpha$=180°). The shafts rotate therein in the direction indicated by arrows.

In order to be able to determine the exact position of the unbalanced masses, sine-cosine transmitters 12 are provided, which have a resolution of over 65500 increments/revolution. As can be recognized in FIG. 6, these are not attached to the unbalance shafts on the vibrating table 1, but instead on the motor shafts of the servo-motors 8.

In that the drive gears 13, which are mounted on the motor shafts, have the same size as the driven gears 5, by which the unbalance shafts are driven, it is achieved that between the motor shaft and the unbalance shaft a fixed translation ratio of 1:1 is ensured, and thus from the angular adjustment and the rotational speed of the motor shaft, a conclusion can be reached immediately about the angular adjustment and rotational speed of the unbalance shafts.

In the embodiment depicted the motors are coupled as master (8*a*) and slave (8*b*). The control or regulation of the motors is accomplished in a fully digitalized manner using a sensing time on the order of magnitude of approx. 60 $\mu$sec. Thus, an angular difference of far less than one degree can be realized between the individual motors and thus between the unbalance shafts.

In the embodiment depicted the position regulator, which creates the synchronization of the slave drive with the master drive, is also readily integrated into the regulation electronics for motor guidance, since in this way short signal run times are possible between the position regulator and the rotational speed regulator. Also, the evaluation of the individual sine-cosine transmitters is suitably integrated into each drive, so that the calculation performance required for the actual control need not be branched off for this.

Figure 6:
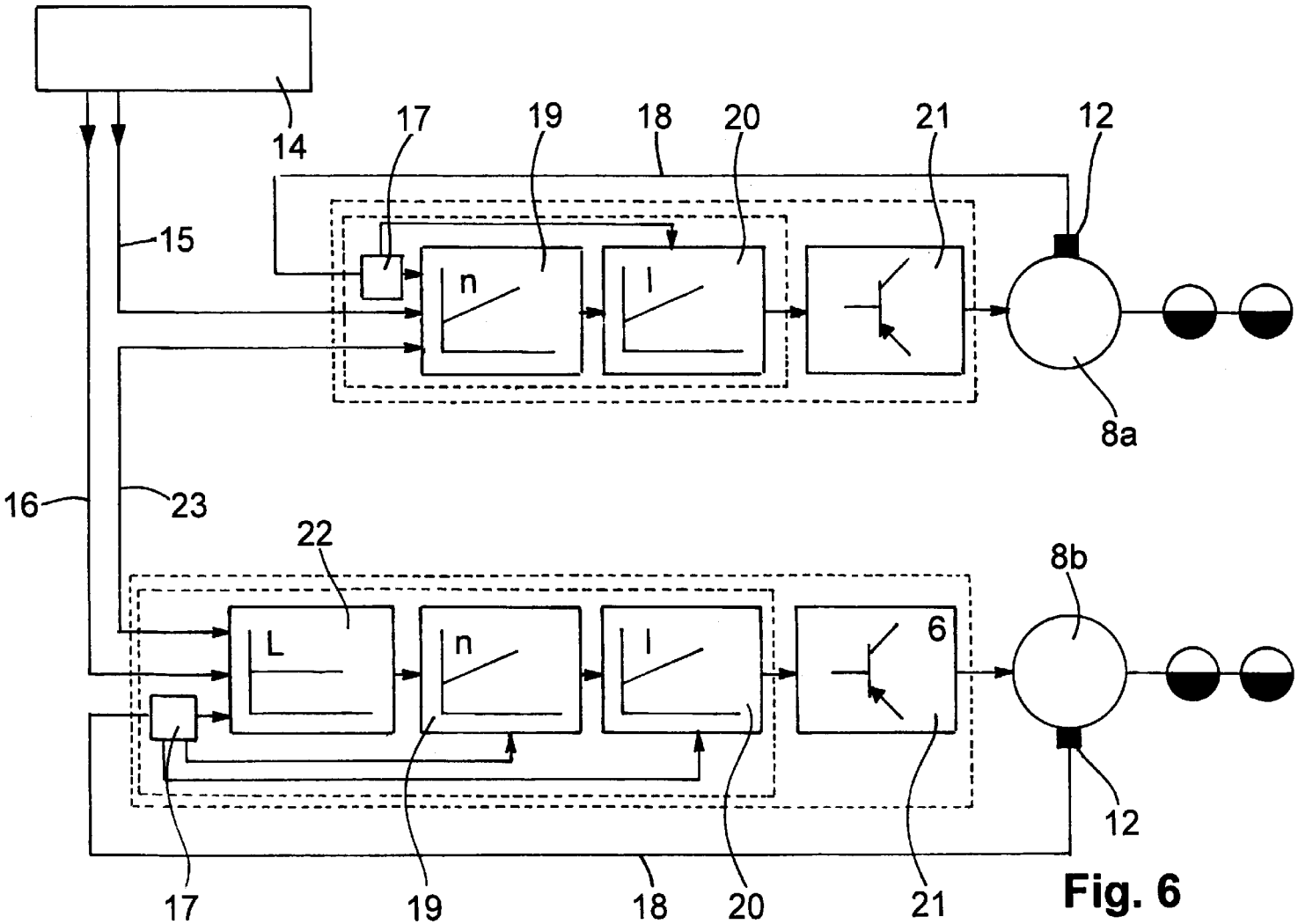
FIG. 6 is a schematic diagram of the circuitry of the electronic regulator for the drive according to the invention.

As recognized from FIG. 6, the control electronics of the master or slave drive 8*a* or 8*b* are connected in circuit prior to a control 14, which prescribes the target values, i.e., on the one hand gives the target rotational speed value 15 for the master drive, or on the other hand gives the corresponding target angle value 16 to the slave drive. The actual values additionally required in this for the position, rotational speed, and rotor angle are formed by each servo-motor in its own control by a transmitter evaluator 17 from the transmitter signals 18 delivered from the sine-cosine transmitters.

For the motor control itself, no additional position regulator is necessary. This is accomplished using only the rotational speed regulator 19 and the current regulator 20. After the current regulator the flow control of the machine then occurs, with a selected motor model, through a coordinate transformation of the target values and with the rotor position information of the transmitter evaluator 17. The target values calculated there are then supplied to the power unit 21.

As stated above, the target rotational speed value 15 is supplied therein to the control or master drive 8*a* by the control 14, which acts directly on the rotational speed regulator 19. Contrary to this, the dependent or slave drive 8*b* receives from the higher-order control 14 the predetermined target value for the offset angle 16, which acts on the position regulator 22. In order to create the required synchronization between the master drive 8*a* and the slave drive 8*b*, the position regulator 22 is further supplied with position information 23 of the master drive.

All controllers, up to the position regulator 22, which is a pure P-regulator, are constructed in this embodiment as PI-regulators, in order to achieve a rapid stabilization using a small regulation deviation.

With a device of this type it is possible to change simultaneously the rotational speed and the angular displacement during operation, wherein here the change of the angle and the rotational speed can occur simultaneously. Also, the rotational direction can be reversed and the phase angle can be selectively advanced or retarded, whereby useful effects can be obtained in practice. The adjustment time that can be obtained, in order to adjust the phase position by a full 180°, amounts to about 125 milliseconds, wherein the times of the advance and return positioning can, however, also be changed as desired.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

I claim:

1. An unbalanced vibrator for compacting concrete components during their manufacture, comprising a vibrating table (1) having unbalance shafts (2, 3) arranged on the vibrating table and electronic motors (8) allocated to the unbalance shafts (2, 3) in order to drive the unbalance shafts (2, 3), and a control device for the control of a rotational speed of the unbalance shafts (2, 3), wherein the electronic motors (8) are servo-motors having motor control electronic system, and wherein the control device includes sine-cosine transmitters (12) that determine the rotational speed of the unbalance shafts.

2. The unbalanced vibrator according to claim 1, wherein the sine-cosine transmitters (12) determine the rotational speed of shafts of the electronic motors (8), and the electronic motor shafts are connected to the unbalance shafts (2, 3) via a fixed translation ratio.

3. The unbalanced vibrator according to claim 2, wherein the translation ratio is 1:1.

4. The unbalanced vibrator according to claim 1, wherein a total of four unbalance shafts (2, 3) are provided, which are coupled in pairs running in opposite directions via toothed belts (7).

5. The unbalanced vibrator according to claim 4, wherein each pair of shafts coupled together lies in a horizontal plane and the individual pairs lie above each other in a vertical direction.

6. The unbalanced vibrator according to claim 4, wherein each pair of unbalance shafts is coupled to a separate servo-motor (8).

7. The unbalanced vibrator according to claim 6, wherein with two electronic motors (8), a first is equipped as a master drive (8*a*) and a second is equipped as a slave drive (8*b*).

8. The unbalanced vibrator according to claim 7, wherein a position controller (22) that synchronizes the slave drive (8*b*) is integrated into the motor control electronic system of the slave drive (8*b*).

9. The unbalanced vibrator according to claim 1, wherein each motor control electronic system has allocated to it its own evaluation unit (17) for a sine-cosine transmitter (12), which forms actual values for the individual controllers (19, 20, 22).

10. The unbalanced vibrator according to claim 1, wherein the motor control electronic systems (17, 19, 20, 22) are fully digitalized and have a sensing time of less than 75 μsec.

11. An unbalanced vibrator for compacting concrete components during their manufacture, comprising a vibrating table (1) having unbalance shafts (2, 3) arranged on the vibrating table and electronic motors (8) allocated to the unbalance shafts (2, 3) in order to drive the unbalance shafts (2, 3), and a control device for the control of a relative phase position of the unbalance shafts (2, 3), wherein the electronic motors (8) are servo-motors having motor control electronic systems and wherein the control device includes sine-cosine transmitters (12) that determine the relative phase position of the unbalance shafts.

12. The unbalanced vibrator according to claim 11, wherein the sine-cosine transmitters (12) determine the relative phase position of shafts of the electronic motors (8), and the electric motor shafts are connected to the unbalance shafts (2, 3) via a fixed translation ratio.

13. The unbalanced vibrator according to claim 12, wherein the translation ratio is 1:1.

14. The unbalanced vibrator according to claim 11, wherein a total of four unbalance shafts (2, 3) are provided, which are coupled in pairs running in opposite directions via toothed belts (7).

15. The unbalanced vibrator according to claim 14, wherein each pair of shafts coupled together lies in a horizontal plane and the individual pairs lie above each other in a vertical direction.

16. The unbalanced vibrator according to claim 14, wherein each pair of unbalance shafts is coupled to a separate servo-motor (8).

17. The unbalanced vibrator according to claim 16, wherein with two electronic motors (8), a first is equipped as a master drive (8*a*) and a second is equipped as a slave drive (8*b*).

18. The unbalanced vibrator according to claim 17, wherein a position controller (22) that synchronizes the slave drive (8*b*) is integrated into the motor control electronic systems of the slave drive (8*b*).

19. The unbalanced vibrator according to claim 11, wherein each motor control electronic system has allocated to it its own evaluation unit (17) for a sine-cosine transmitter (12), which forms actual values for the individual controllers (19, 20, 22).

20. The unbalanced vibrator according to claim 11, wherein the motor control electronic systems (17, 19, 20, 22) are fully digitalized and have a sensing time of less than 75 μsec.

21. An unbalanced vibrator for compacting concrete components during their manufacture, comprising a vibrating table (1) having unbalance shafts (2, 3) arranged on the vibrating table and electronic motors (8) allocated to the unbalance shafts (2, 3) in order to drive the unbalance shafts (2, 3), and a control device for the control of a rotational speed and a relative phase position of the unbalance shafts (2, 3), wherein the electronic motors (8) are servo-motors having motor control electronic systems and wherein the control device includes sine-cosine transmitters (12) that determine the relative phase position and rotational speed of the unbalance shafts.

22. The unbalanced vibrator according to claim 21, wherein the sine-cosine transmitters (12) determine the relative phase position and rotational speed of shafts of the electronic motors (8), and the electronic motor shafts are connected to the unbalance shafts (2, 3) via a fixed translation ratio.

23. The unbalanced vibrator according to claim 22, wherein the translation ratio is 1:1.

24. The unbalanced vibrator according to claim 21, wherein a total of four unbalance shafts (2, 3) are provided, which are coupled in pairs running in opposite directions via toothed belts (7).

25. The unbalanced vibrator according to claim 24, wherein each pair of shafts coupled together lies in a horizontal plane and the individual pairs lie above each other in a vertical direction.

26. The unbalanced vibrator according to claim 24, wherein each pair of unbalance shafts is coupled to a separate servo-motor (8).

27. The unbalanced vibrator according to claim 26, wherein with two electronic motors (8), a first is equipped as a master drive (8*a*) and a second is equipped as a slave drive (8*b*).

28. The unbalanced vibrator according to claim 27, wherein a position controller (22) that synchronizes the slave drive (8*b*) is integrated into the motor control electronic system of the slave drive (8*b*).

29. The unbalanced vibrator according to claim 21, wherein each motor control electronic system has allocated to it its own evaluation unit (17) for a sine-cosine transmitter (12), which forms actual values for the individual controllers (19, 20, 22).

30. The unbalanced vibrator according to claim 21, wherein the motor control electronic systems (17, 19, 20, 22) are fully digitalized and have a sensing time of less than 75 μsec.

31. An unbalanced vibrator for compacting concrete components during the manufacture thereof, comprising a vibrating table (1) having unbalance shafts (2, 3) arranged on the vibrating table and electronic motors (8) allocated to the unbalance shafts (2, 3) in order to drive the unbalance shafts (2, 3), and a control device for the control of a force generated by the unbalance shafts (2, 3) resulting on the vibrating table (1), wherein the electronic motors (8) are servomotors having motor control electronics and wherein sine-cosine transmitters (12) are associated with the motor control electronics, said sine-cosine transmitters (12) generate signals from which the force generated by the unbalance shafts (2, 3) is determined.

* * * * *